US007431103B2

(12) United States Patent
Schell et al.

(10) Patent No.: US 7,431,103 B2
(45) Date of Patent: Oct. 7, 2008

(54) TRIGGER ASSEMBLY FOR NAILER

(75) Inventors: Craig A. Schell, Baltimore, MD (US); Ashok Samuel Baskar, Lutherville, MD (US); Paul G. Gross, White Marsh, MD (US); Charles L. Bradenbaugh, IV, Fincastle, VA (US); Robert Alan Berry, Fincastle, VA (US); David C. Tomayko, Ellicott City, MD (US); Li Xu, Woodstock, MD (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 11/732,684

(22) Filed: Apr. 4, 2007

(65) Prior Publication Data

US 2007/0175943 A1 Aug. 2, 2007

Related U.S. Application Data

(62) Division of application No. 11/068,344, filed on Feb. 28, 2005, now Pat. No. 7,213,732.

(60) Provisional application No. 60/559,343, filed on Apr. 2, 2004.

(51) Int. Cl.
*B25C 1/04* (2006.01)

(52) U.S. Cl. ..... 173/170; 173/171; 227/8; 227/156; 16/110.1; 200/332.2; 200/343

(58) Field of Classification Search ..... 227/8, 227/130, 156; 173/170, 171; 16/110.1, 111.1; 200/332.2, 343
See application file for complete search history.

(56) References Cited

U.S. PATENT DOCUMENTS 2,786,672 A 3/1957 Humphner
3,018,584 A 1/1962 Passariello
3,250,882 A * 5/1966 Campbell et al. ..... 200/343
4,042,036 A 8/1977 Smith et al.
4,054,766 A * 10/1977 Kramer ..... 200/522
4,121,745 A 10/1978 Smith et al.
4,129,240 A 12/1978 Geist
4,271,342 A * 6/1981 Sistare ..... 200/332.2
4,298,072 A 11/1981 Baker et al.
4,523,695 A * 6/1985 Braun et al. ..... 227/8
4,721,170 A 1/1988 Rees
D307,234 S 4/1990 Fushiya et al.
4,928,868 A 5/1990 Kerrigan
5,002,135 A * 3/1991 Pellenc ..... 173/170
D322,204 S 12/1991 Lee
5,069,379 A 12/1991 Kerrigan
5,071,052 A * 12/1991 Rodak et al. ..... 227/175.2
5,083,694 A * 1/1992 Lemos ..... 227/8
5,098,004 A 3/1992 Kerrigan
D330,836 S 11/1992 Fushiya et al.

(Continued)

*Primary Examiner*—Scott A. Smith
(74) *Attorney, Agent, or Firm*—Harness, Dickey & Pierce, P.L.C.

(57) ABSTRACT

A contact trip assembly for a power nailer, wherein a contact member includes a curved portion that loops rearwardly towards a handle of the nailer. Also provided is an adjustment assembly including an adjustment plate and a pinion gear, a trigger that is slidably engageable within a housing of the tool, a trigger lock including a ring element, an anti-discharge mechanism including a stop member, and a contact trip lock.

9 Claims, 8 Drawing Sheets

U.S. PATENT DOCUMENTS

D333,601 S 3/1993 Wingert
D338,606 S 3/1993 Oda
5,219,110 A 6/1993 Mukoyama
D340,630 S 10/1993 Hara
D350,681 S 9/1994 Juhlin et al.
5,443,196 A 8/1995 Burlington
5,551,621 A * 9/1996 Vallee ..... 227/8
D376,523 S 12/1996 Arai
5,593,079 A 1/1997 Mukoyama et al.
D383,657 S 9/1997 Kaiser
5,715,982 A 2/1998 Adachi
5,749,457 A * 5/1998 Castaneda et al. ..... 200/343
5,785,227 A 7/1998 Akiba et al.
5,813,520 A * 9/1998 Reier et al. ..... 200/343
5,873,510 A * 2/1999 Hirai et al. ..... 227/130
D406,999 S 3/1999 Sover et al.
D410,182 S 5/1999 Etter et al.
6,024,267 A 2/2000 Chen
D426,124 S 6/2000 Kassalen et al.
D432,077 S 10/2000 Zurwelle et al.
D435,013 S 12/2000 Clowers et al.
D435,769 S 1/2001 Etter et al.
6,186,386 B1 2/2001 Canlas et al.
D440,136 S 4/2001 Buck
6,244,358 B1 * 6/2001 Beer et al. ..... 173/178
6,355,892 B1 * 3/2002 Marks ..... 200/332.2
6,357,534 B1 3/2002 Buetow et al.
6,367,156 B1 * 4/2002 Herrmann et al. ..... 30/228
D459,184 S 6/2002 Buck
6,419,140 B1 * 7/2002 Chen ..... 227/8
D461,694 S 8/2002 Buck
6,431,425 B1 * 8/2002 Moorman et al. ..... 227/8
D466,863 S 12/2002 Zurwelle et al.
6,488,195 B2 12/2002 White et al.
D476,151 S 6/2003 Peterson
6,705,501 B2 3/2004 Miller et al.
6,783,044 B2 8/2004 Perra et al.
6,866,177 B1 3/2005 Chen
6,929,165 B1 * 8/2005 Chen et al. ..... 227/8
6,959,850 B2 11/2005 Taylor et al.
2002/0185514 A1 12/2002 Adams et al.

* cited by examiner

TRIGGER ASSEMBLY FOR NAILER

CROSS-REFERENCE TO RELATED APPLICATIONS

This application is a divisional of U.S. application Ser. No. 11/068,344, filed Feb. 28, 2005 U.S. Pat. No. 7,213,732 issued May 8, 2007, which claims the benefit of U.S. Provisional Application No. 60/559,343, filed on Apr. 2, 2004, the disclosure of which is incorporated herein by reference.

FIELD OF THE INVENTION

The present invention relates to a power tool such as a power nailer. More particularly, the present invention relates to a contact trip mechanism for a power nailer.

BACKGROUND OF THE INVENTION

Fastening tools, such as power nailers and staplers, are relatively common place in the construction trades. Often times, however, the fastening tools that are available may not provide the user with a desired degree of flexibility and freedom due to the presence of hoses and such that couple the fastening tool to a source of pneumatic power. Similarly, many features of typical fastening tools, while adequate for their intended purpose, do not provide the user with the most efficient and effective function. Accordingly, there remains a need in the art for an improved fastening tool.

SUMMARY OF THE INVENTION

The present invention provides a contact trip assembly for a power nailer, wherein a contact member includes a curved portion that loops rearwardly towards a handle of the nailer. Also provided is a contact trip adjustment assembly including an adjustment plate and a pinion gear, a trigger that is slidably engageable within a housing of the tool, a trigger lock including a ring element, an anti-discharge mechanism including a stop member, and a contact trip lock.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

Figure 1:
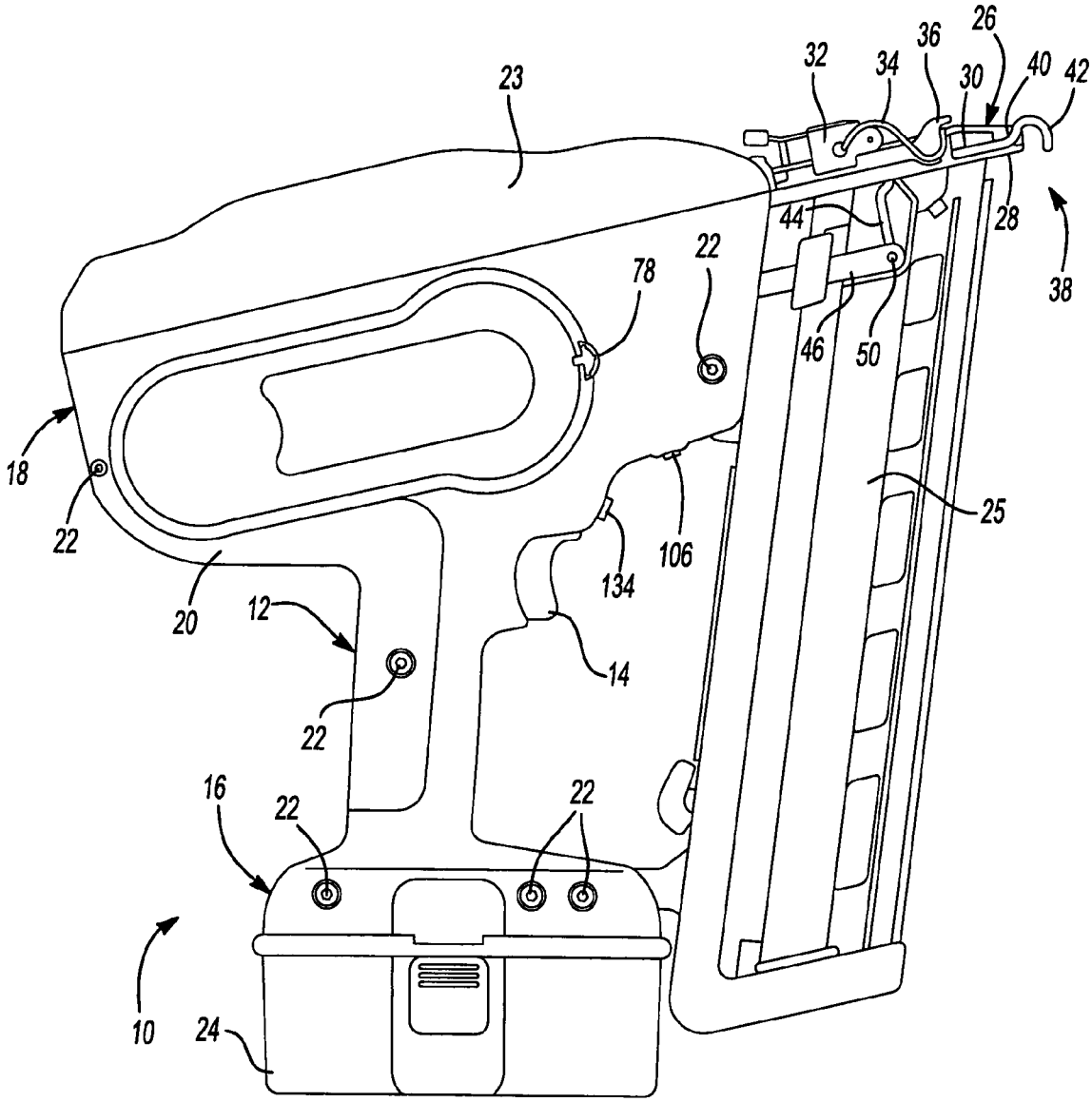
FIG. 1 is a side view of a power nailer according to the present invention.

FIG. 1 is a side view of a powered fastener tool 10 according to the principles of the present invention. The tool 10 includes a main body portion 18 and a handle assembly 12, a trigger 14, and a base 16. Preferably, the handle assembly 12, base 16, and main body portion 18 are in the form of a two-piece housing 20 that is fastened together by screws 22 or the like. A backbone cover 23 is provided at the top of the main body portion 18. As shown in FIG. 1, a magazine 25 extends between the base 16 and front of the main body portion 18. A power source 24, such as a battery is mounted to the base 16 so that the tool 10 can be used as a cordless tool 10. It should be noted, however, that the tool 10 should not be limited to just the cordless configuration. More particularly, the tool 10 can be powered by an AC power source through a power cord, pneumatically powered by air or the like, powered by internal combustion, or any other power source known in the art.

The tool 10 also includes a nose assembly 26 disposed at a top of the magazine 25. The magazine 25 holds fasteners such as nails or staples. The nose assembly 26 includes a nosepiece 28 that guides the fasteners toward a workpiece (not shown) when the tool 10 is discharged, and a nose cover 30 that is pivotably connected to the nosepiece 28 so that the nose cover 30 may be opened if a fastener were to become jammed in the nosepiece 28. The nose cover 30 is secured to the nosepiece 28 by a latch assembly 32 that includes a latch wire 34. The latch wire 34 engages a pair of flanges 36 on the nosepiece 28 to firmly close the nose cover 30.

Figure 2A:
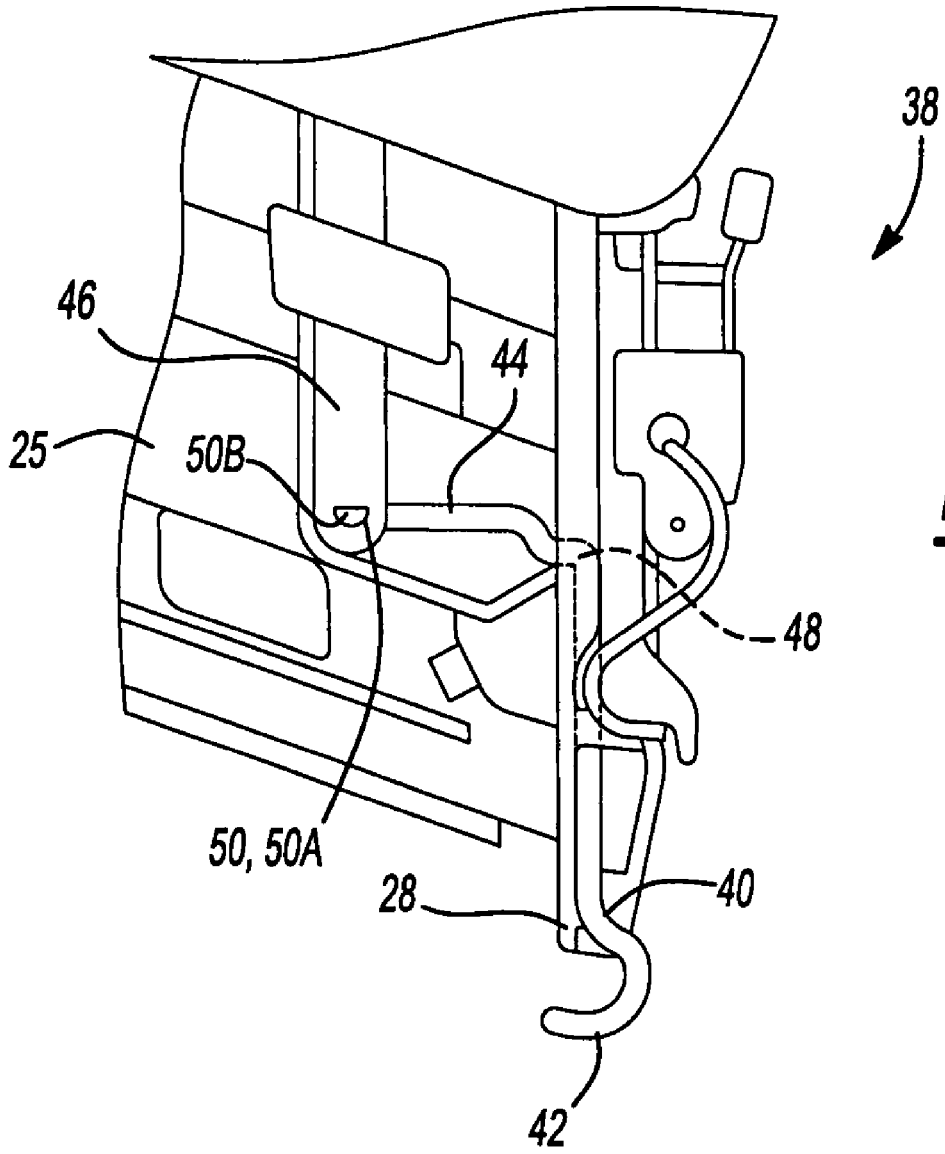
FIG. 2 is a side view of a contact trip assembly according to the principles of the present invention.
Figure 2B:
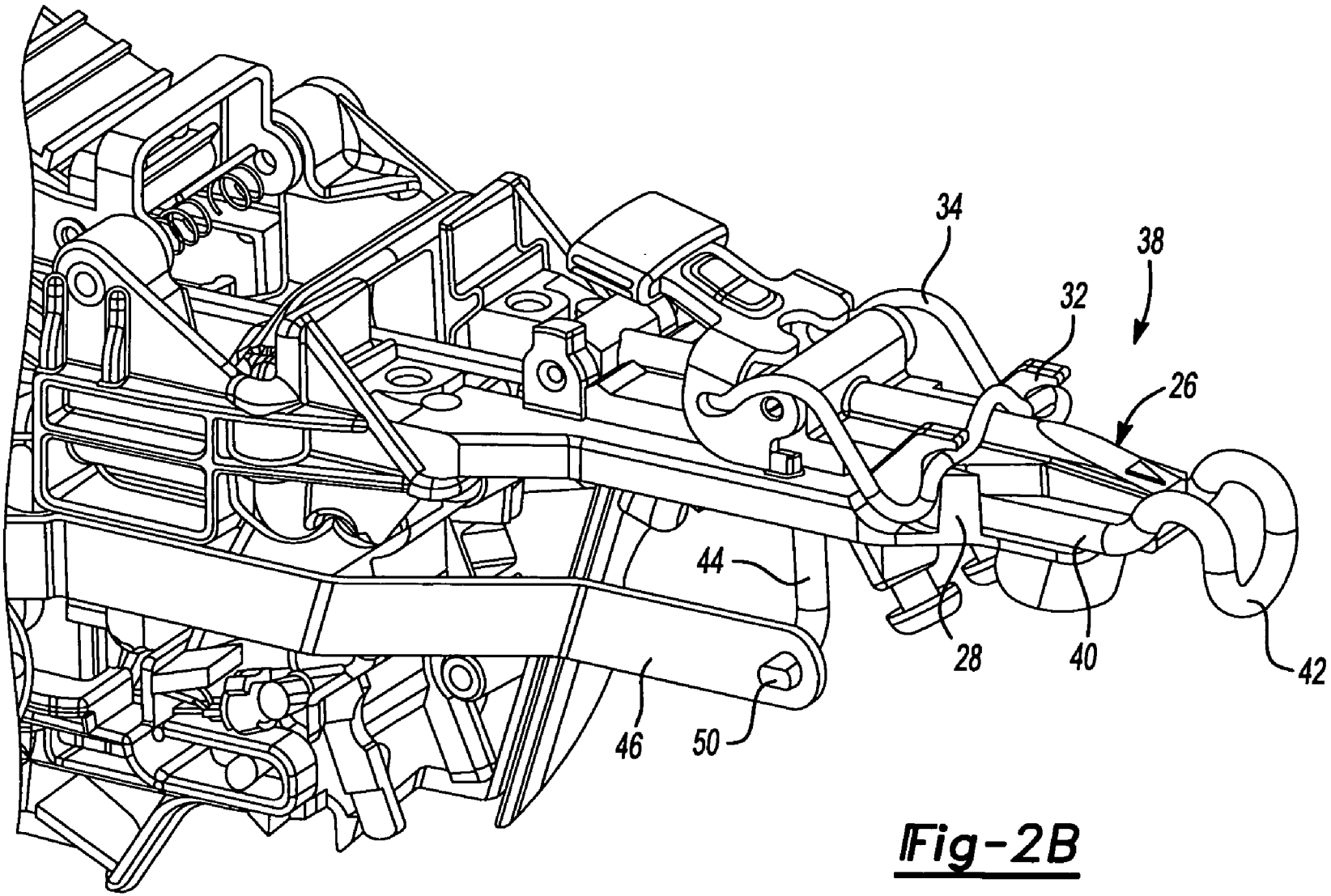

In accordance with the present invention, the nose assembly 26 also includes a contact trip assembly 38 that extends forward from the nosepiece 28 and prevents the tool 10 from an inadvertent actuation. Referring to FIG. 2, the contact trip assembly 38 includes a lower contact member 40, or guide portion 40, that extends along and outward from the nosepiece 28. Preferably, the lower contact member 40 is formed of a heavy wire that is tough and rigid so that the lower contact member 40 is long-lasting and durable. A preferable material to form the lower contact member 40 is a high-carbon spring steel. By utilizing such a material, the lower contact member 40 is not easy to bend, but still provides a good sliding surface against the nosepiece 28 when the lower contact member 40 is engaged against a workpiece. It should be understood, however, that any material known in the art that provides rigidity and toughness, as well as a good sliding surface may be used to form the lower contact member 40.

A portion of the lower contact member 40 that extends outward from the nosepiece 28 is a curved portion 42 that loops rearwardly toward the handle 12 and base portion 16 of the tool 10. Since the curved portion 42 loops rearwardly, the lower contact member 40 will not be in a user's line of sight when using the tool 10. Further, the curved design of the lower contact member 40 enables the tool 10 to keep good penetration performance when the tool is rotated off a perpendicular axis of the workpiece. That is, when the tool 10 is angled against a workpiece, the curved portion 42 allows contact trip assembly 38 to keep good contact with the workpiece, which in turn allows the tool 10 to maintain a desired penetration depth of the fastener into the workpiece when the tool 10 is discharged. In this manner, the tool 10 is more efficient during uses such as toe-nailing.

The lower contact member 40 also includes an arm portion 44 that is connected to a link member 46 of the contact trip assembly 38. The arm portion 44 of the lower contact member 40 begins at an elbow portion 48 of the lower member 40 that connects the curved portion 42 and arm portion 44. Preferably, the arm portion 44 extends downward along the magazine 25 at approximately a right angle (90°) from the curved portion 42 of the lower contact member 40, but the present invention should not be limited thereto. Preferably, the arm portion 44 is non-rotatably connected to the link member 46 by way of a D-shaped joint 50 including a D-shaped slot 50A in the link member 46 and a D-shaped or flattened end 50B. In this manner, the lower member 40 and link member 46, when engaged against a workpiece, are actuated in one direction like a unitary assembly.

Figure 3A:
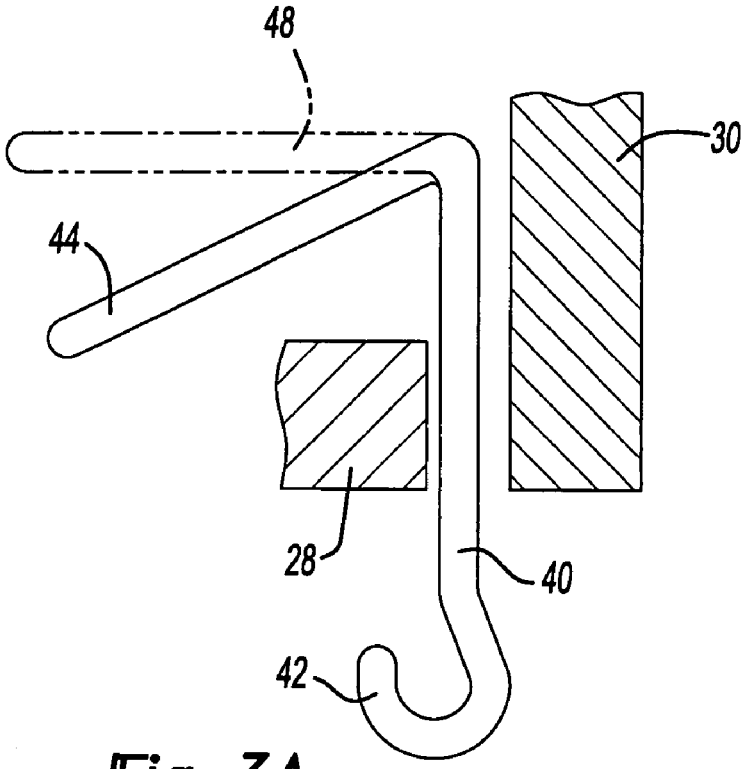
FIG. 3 is a side view of the contact trip assembly according to the present invention showing an improved point of deformation.
Figure 3B:
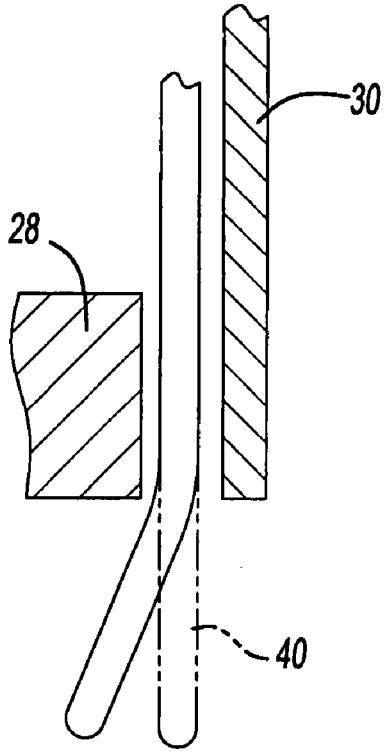
Fig-3B PRIOR ART

Further, the arm portion 44 and elbow portion 48 provides an improved point of deformation in the contact trip assembly 38. That is, referring to FIG. 3, if the tool 10 is dropped, the contact trip assembly 38 will bend or deform at this portion of the assembly 38 instead of having the lower member 40 bend at a portion extending from the nosepiece 28. This is an important aspect of the invention in that such a design does not allow the contact trip assembly 38 to become lodged in the nosepiece 28 of the tool 10 in an up position if the assembly 38 is damaged during a dropping of the tool 10. As such, the contact trip assembly 38 of the tool 10 of the present invention remains safe (that is the contact trip assembly 38 will not be locked in an upward position) during use because, although the contract trip assembly 38 may deform at this portion, the assembly 38 will still operate in the fashion of a unitary assembly, described above.

Figure 4A:
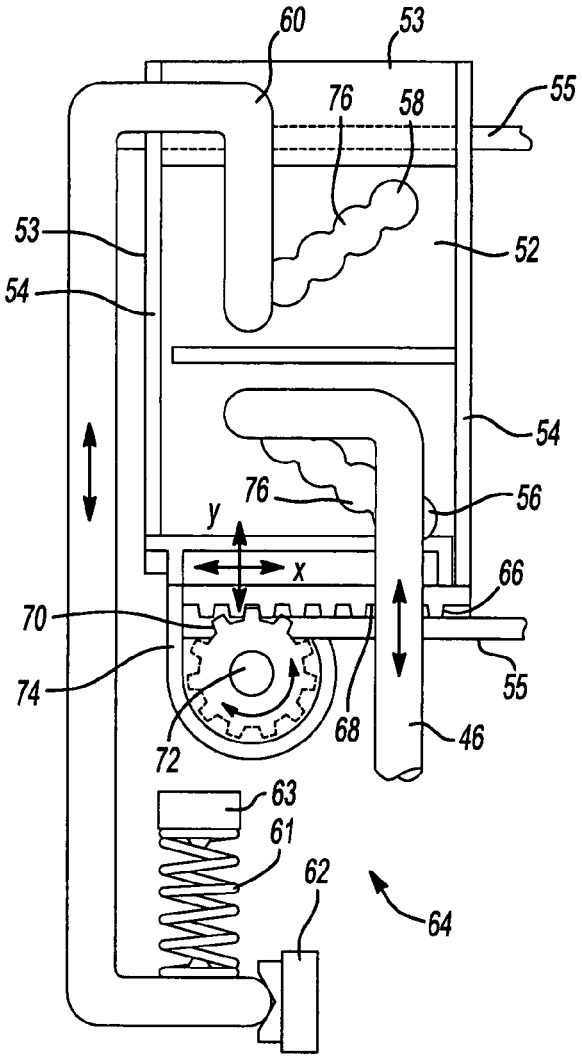
FIGS. 4A and 4B are side views of a depth adjustment assembly shown in different adjustment positions according to the principles of the present invention.

Now referring to FIG. 4A, it can be seen that the link member 46 of the contact trip assembly 38 extends inwardly from the nosepiece assembly 26 into the housing 20 of the tool 10. The link member 46 is preferably a flat member that is, preferably, formed of a metal such as steel or aluminum. In the housing 20, the link member 46 is engaged with an adjustment plate 52 that is slidably mounted to a slider plate 53 by rails 54 (extending vertically as viewed in FIG. 4A). Due to the rails 54, the adjustment plate 52 is vertically (in the y-direction) movable within the slider plate 53, while the slider plate 53 is laterally (in the x-direction) movable upon rails 55. The rails 55 upon which the slider plate 53 is laterally movable are mounted to a backbone assembly 100, which supports the motor and driving mechanisms (not shown) within the housing 20. Preferably, the slider plate 53 is formed of a plastic material.

The adjustment plate 52, which is preferably formed of a metal such as aluminum or steel, includes a lower cam slot 56 and an upper cam slot 58, with the link member 46 being movably engaged with the lower cam slot 56 and an upper member 60 of the contact trip assembly being movably engaged with the upper cam slot 58. As such, when the link member 46 is pushed upwardly, i.e., when the tool 10 is pushed downwardly against a workpiece, the adjustment plate 52 and the upper member 60 of the contact trip assembly 38 also move upward. Upper member 60 acts as the upper constraint to ground the adjustment plate 52 and slider plate 53. That is, when the upper member 60 is pushed upwardly, it will contact flange 107 (FIG. 6) to thereby prevent further movement of the adjustment plate 52.

Figure 4B:
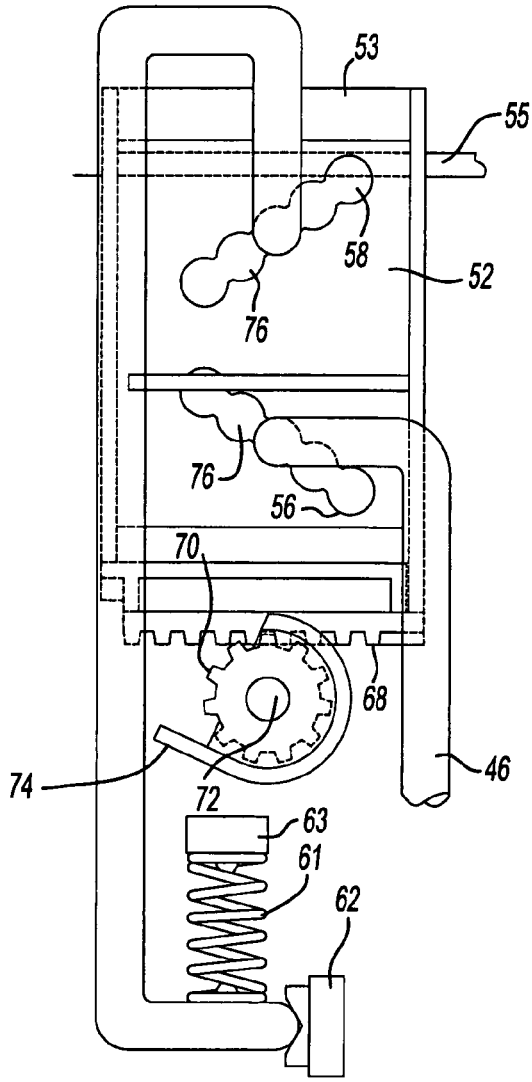

The upper member 60 is also coupled to a switch 62. As stated above, when the contact trip assembly 38 is engaged against a workpiece, the upper member 60 is also pushed upwards. This upward motion closes the switch 62 and allows the tool 10 to be discharged or allows the motor to start up, depending on the operating mode. In order to bias the contact trip assembly downward and keep the switch 62 open when the tool 10 is not pressed against a workpiece, a spring 61, that is attached to a boss 63, engages the upper member 60 for biasing the upper member 60 downward. Although the spring 61 is depicted engaged with the upper member 60 in FIG. 4, it should be understood that the spring 61 can alternatively be engaged with the slider plate 53 or link member 46 in order to return the contact trip assembly to its forward position.

The contact trip assembly 38 is also an adjustable assembly. That is, the contact trip assembly 38 may be adjusted such that the lower contact member 40 of the contact trip assembly 38 can be adjusted to extend outward from the nosepiece assembly 26 to a variety of depths. In this manner, when a fastener is discharged from the tool 10, a penetration depth of the fastener into a workpiece may also be adjusted.

Still referring to FIG. 4A, the adjustable contact trip assembly 64 will now be described. It should be noted that although the lower contact member 40 depicted in FIG. 2, is not shown in FIG. 4A, the lower contact member 40 is also a part of the adjustable contact trip assembly 38. The slider plate 53 includes, in addition to the adjustment plate 52, a rack 66. The rack 66 is disposed at an edge of the slider plate 53 and includes a plurality of teeth 68 which engage with the teeth 70 of a pinion gear 72. The pinion gear 72 preferably is attached to a J-shaped flange 74. More preferably, the pinion gear 72 and the J-shaped flange 74 are in the form of a monolithic piece. When the pinion 72 is rotated, the slider plate 53 is caused to move in a lateral direction along the rails 55. The pinion 72 and rack 66, therefore, act as a lateral constraint on the adjustment plate 52 and slider plate 53.

A unique aspect of the adjustment assembly 64 is the J-shaped flange 74 that is supported with the pinion gear 72. Due to the J-shaped flange 74 and pinion gear 72 preferably being in the form of a monolithic piece, only three teeth 70 of the pinion gear 72 are exposed to the teeth 68 of the rack 66. During assembly, the pinion 72 is pushed into contact with the rack 66. Without the J-shaped flange 74, the pinion 72 could be installed anywhere along the rack 66. Due to the J-shaped flange 74, however, the pinion 72 can only be properly installed in one position. The slider plate 53, therefore, can only bypass the J-shaped flange 74 and pinion gear 72 from one position. Accordingly, the J-shaped flange 74 guarantees that the same 3 teeth 70 are always meshed with the first teeth 68 of the rack 66 to assure proper assembly. As such, a full range of adjustment for the contact trip assembly 38 can be achieved.

Figure 5:
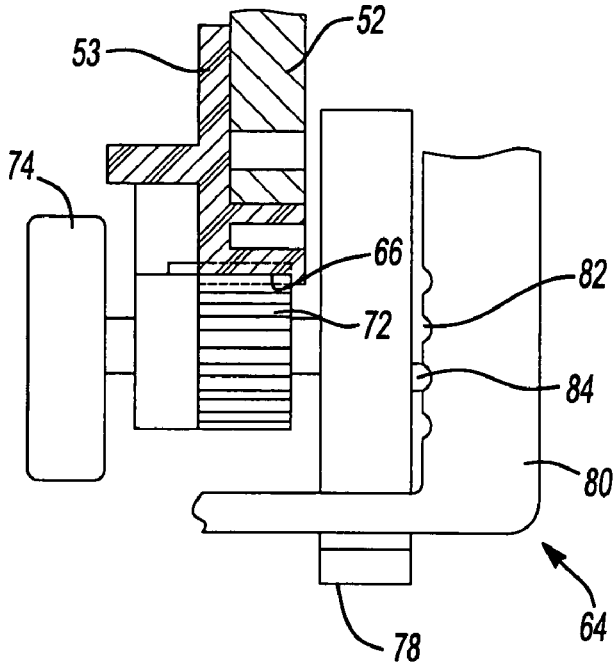
FIG. 5 is a front-side view of the depth adjustment assembly according to the principles of the present invention.

Now referring to FIG. 5, it can be seen that the pinion gear 72 and J-shaped flange 74 are also coupled to a dial knob 78 that is partially enclosed by a cage or subcover 80. In a preferred embodiment, the pinion gear 72, J-shaped flange 74, and dial knob 78 are also in the form of a monolithic piece. In should be understood, however, that such an embodiment is merely the most preferable. As such, the pinion gear 72 and J-shaped flange 74 can be a detachable piece from the dial knob 78, and still be within the spirit and scope of the present invention.

On the inside of the subcover 80 are a plurality of notches or detents 82 that engage with a bump 84 located on the dial knob 78. As such, when the dial knob 78 is rotated by a user, the bump 84 on the dial knob 78 may be moved into the different notches 82 of the subcover 80. Since the dial knob 78 is a unitary piece including the pinion gear 72 and J-shaped flange 74, the dial knob 78 also rotates the pinion gear 72 and J-shaped flange 74 to adjust a lateral position of the slider plate 53 which, in turn, adjusts a depth of the contact trip assembly 38. In this manner, a variety of depths for the contact trip assembly 38 can be chosen by the user of the tool 10. It should be noted that the dial knob 78 preferably has numbers printed on a surface that is viewable from outside the housing 20 that indicate and assist a user in choosing the correct depth setting for a particular job. It should also be noted that since the J-shaped flange 74 assists in ensuring engagement of the proper teeth 70 of the pinion 72 with the proper teeth 68 of the rack 66, and the J-shaped flange 74, pinion 72, and dial knob 78 are preferably in the form of a monolithic piece, the proper number printed on the dial knob 78 will always indicate the appropriate and correct depth setting chosen by the user.

Further, since the upper and lower cam slots 58 and 56 of the adjustment plate 52 contain a plurality of engagement positions or steps 76, bosses (not shown) that are formed on the link member 46 and upper member 60 and connect the link member 46 and upper member 60 to the cam slots 56 and 58 will move into new positions 76 of the cam slots 56 and 58 as the slider plate 53 is moved laterally by the dial knob 78. That is, referring to FIG. 4B, as the slider plate 53 is moved laterally (in the x-direction) by rotation of the dial knob 78 and pinion gear 72, the bosses of the link member 46 and upper member 60 will be forced to move into new positions 76 of the cam slots 56 and 58. As the boss of the upper member 60 is moved into a new position 76, the adjustment plate 52 is adjusted vertically (in the y-direction) to accommodate the boss of the upper member 60 being adjusted. As such, it should be understood that the upper member 60 remains generally stationary while the knob 78 is rotated by a user.

In contrast, the link member 46 does not remain stationary as the knob 78 is rotated. That is, the link member 46 will move vertically (y-direction) as its boss is moved into a new position 76. Since the link member 46, which is coupled to the lower contact trip assembly 38, moves vertically, a depth of the lower contact trip assembly 38 is adjusted. The positions 76 of the cam slots 56, 58, therefore, dictate the depth of the contact trip assembly 38. As such, the depth of the contact trip assembly 38 can be adjusted to correspond to the number of positions 76 contained in the cam slots 56 and 58. It should be understood that, during the assembly of the adjustment assembly, it is important that the bosses of the link member 46 and upper member 60 are always disposed into corresponding positions 76 of the cam slots 56 and 58 that are in line with one another. Such an assembly ensures that an accurate depth of the contact trip assembly 38 can be achieved when the dial knob 78 is rotated to the desired position (depth). Further, it should be understood that it is impossible to assemble the adjustment mechanism with the bosses of the link member 46 and upper member 60 being misaligned. More specifically, in addition to the bosses that are disposed in the positions 76 of the cam slots 56 and 58, bosses (not shown) are also disposed on the link member 46 and upper member 60 that correspond with slots (not shown) on the inside of the subcover 80. This ensures that the link member 46 and upper member 60 are always disposed into positions 76 of the cam slots 56 and 58 that are in line with one another. Further, the slots on the subcover 80 act as a lateral constraint on the assembly.

Figure 6:
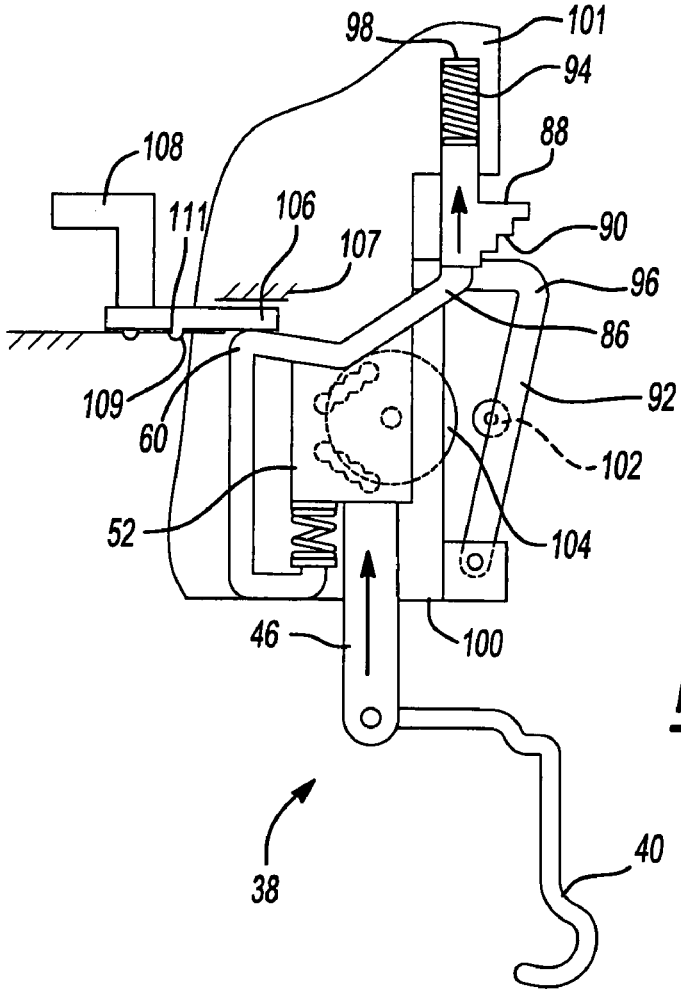
FIG. 6 is an expanded side view including the contact trip assembly, adjustment assembly, contact trip lock, and stop member according to the principles of the present invention.

Now referring to FIG. 6, an impedement mechanism of the present invention will now be described. It should be noted that although upper member 60 and link member 46 are not illustrated as attached to the cam slots 56 and 58 of the adjustment plate 52 in FIG. 6, the upper member 60 and link member 46 are in actuality attached to the cam slots 56 and 58 of the adjustment plate 52. The connection of these elements has been omitted for clarity with respect to a spatial orientation of the elements of the impediment mechanism. In FIG. 6, it can be seen that an extension arm 86 extends from the upper member 60 to a stop member 88. The stop member 88 is an angled member with a step-like or serrated face 90 that is adjacent an activation arm 92. The serrated face 90 provides a gripping surface that ensures sufficient contact between the stop member 88 and the activation arm 92. In this respect, the serrated face 90 could be formed of rubber to provide a sufficient gripping surface and still be within the scope of the present invention. The stop member 88 is also coupled to a spring 94 that biases the stop member 88 to a downward position to engage a face 96 of the activation arm 92. Preferably, the spring 94 is located at an inlet portion 98 of a return housing 101 contained in the housing 20 of the tool 10. When the tool 10 is not in use (that is, the contact trip assembly 38 is not engaged against a workpiece), the stop member 88 impedes the activation arm 92 from contacting a flywheel 104.

More particularly, the activation arm 92 includes a pinch roller 102 that is used to pinch a driver mechanism in the form of a driver blade (not shown) against the flywheel 104. When the driver blade is pinched against the flywheel 104, the driver blade is forced downward to drive the fastener through the nose assembly 26 into a workpiece. By including the stop member 88, the activation arm 92, which is naturally biased towards the flywheel by leaf springs (not shown), is impeded from pivoting towards the flywheel 104 with the pinch roller 102. As such, the driver blade cannot be forced against the fly wheel 104, which prevents a discharge of the tool 10. Notwithstanding, when the contact trip assembly 38 is engaged against a workpiece to cause the contact trip assembly 38 to be forced upward, the upper member 60, which is coupled to the stop member 88, also forces the stop member 88 to be biased upwards against the spring 94. As such, the activation arm 92 is no longer impeded by the stop member 88, and is free to push the pinch roller 102 against the drive mechanism when the trigger 14 of the tool 10 is depressed.

The contact trip assembly 38 of the present invention also includes a contact trip lock 106. Still referring to FIG. 6, it can be seen that the backbone assembly 100 carries a contact trip lock 106 that is rotatable or slidable between two positions. In a first position (locked position), the lock 106 is disposed between a feature (flange) 107 formed on the backbone assembly 100 and the upper member 60 of the contact trip assembly 38. In this position, the contact trip lock 106 prevents the upward movement of the upper member 60 and, therefore, the upward movement of the contact trip assembly 38 thereby disabling the contact trip assembly 38 from allowing the activation of the power nailer. In a second position (unlocked position), the lock 106 is displaced to not contact or obstruct movement of the upper member 60 thereby enabling the contact trip assembly 38 to activate the power nailer. As such, when the tool is engaged against a workpiece, the contact trip assembly 38 is free to move upward and fill the space vacated by the contact trip lock 106. In a variation of the lock 106, the lock 106 may include a spring-loaded ball member (not shown) that engages a recessed portion in the backbone 100 or subcover 80. When the ball member is engaged in the recessed portion, upper member 60 and the contact trip assembly 38 are prevented from moving upwardly.

It is preferable that the lock 106 have a handle or disc 108 that extends through the housing 20 of the tool 10. In this manner, the handle 108 may be manipulated by a user to move the lock 106 between either of the two positions described above. To ensure that the handle 108 is secured into the desired position, there is a detent 109 formed on a surface of the housing 20 which can be engaged with a notch 111 formed on the handle 108. As such, when the handle 108 is manipulated to the first position (locked position), the notch 111 will engage the detent 109 and prevent the contact trip assembly 38 from being engaged, which in turn prevents an inadvertent actuation.

Figure 7A:
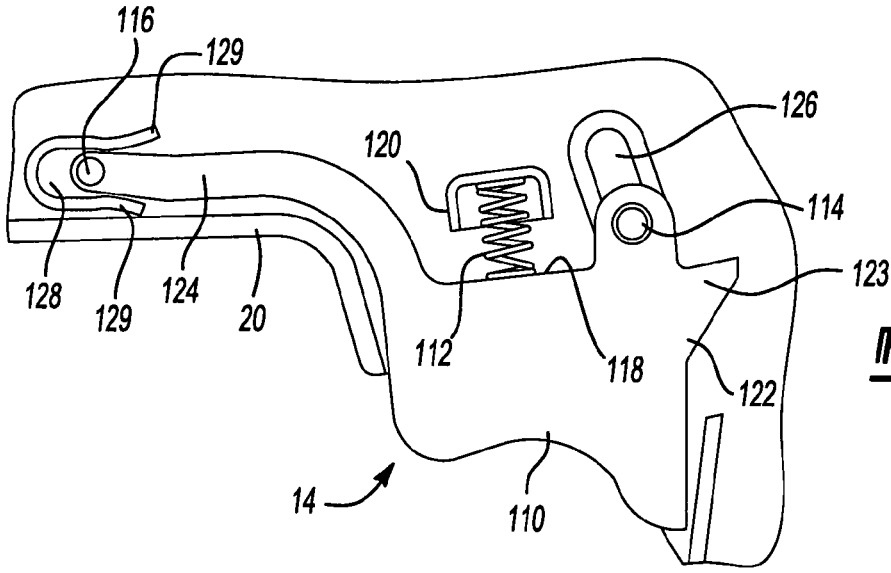
FIG. 7A is a side view of a trigger assembly according to the principles of the present invention in an undepressed state.
Figure 7B:
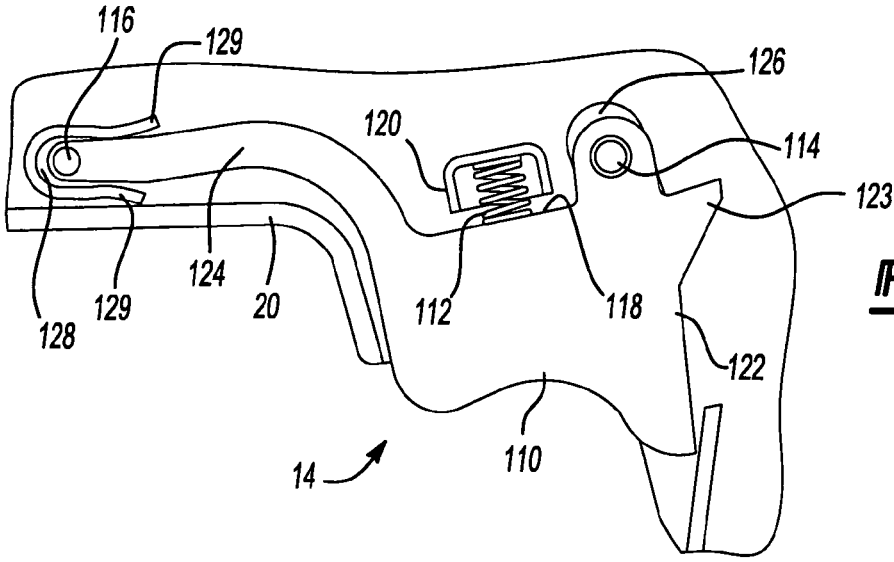
FIG. 7B is a side view of the trigger assembly in a depressed state.
Figure 8:
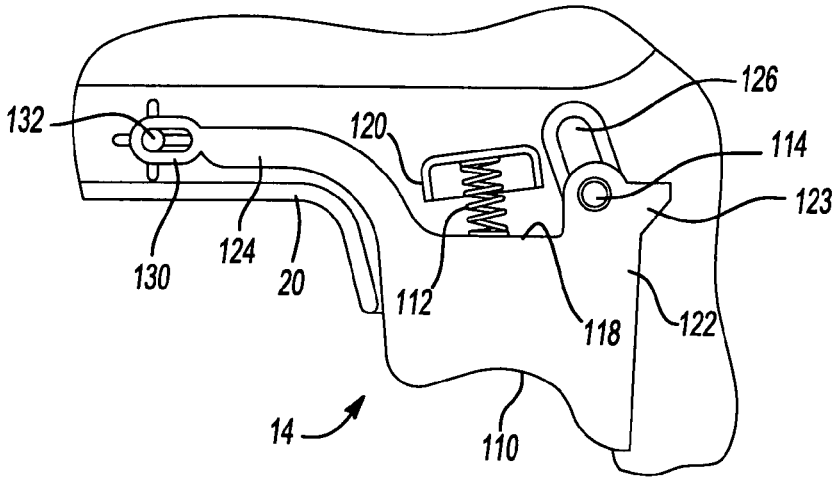
FIG. 8 is a side view of a variation of the trigger according to the principles of the present invention.

Now the trigger assembly 14 of the present invention will be described with reference to FIGS. 7A-7B, and FIG. 8. Referring to FIG. 7A, the trigger 14 is preferably a monolithic plastic piece with a saddle shape 110 where a user's finger engages the trigger 14. The trigger 14 extends into the housing 20 and includes two bosses 114 and 116. A spring 112 is located in a seat portion 118 of the trigger 14 and is compressed against a cleft 120 formed in the housing 20. The bosses 114 and 116 are located at a body portion 122 and tail portion 124 of the trigger 14, respectively, and correspond to and engage with a pair of cam slots 126 and 128. The cam slots include a first cam slot 126 extending angularly toward a rear of the tool and slightly toward the base 16 and a second cam slot 128 extending in the direction of the handle 12 toward the base. With respect to the second cam slot 128, it should be understood that this cam slot is an open cam slot with a pair of angled ribs 129 that guide the tail portion 122 into the horizontal cam slot 128. A configuration where the horizontal cam slot 128 does not have a forward constraint prevents the boss 116 from being broken off of the tail portion 124 in the event that the tool 10 is accidentally dropped a great distance or forcefully causing deflection of the handle 12.

When the trigger 14 is depressed by a user, the bosses 114 and 116 slide along each of the cam slots 126 and 128 in a rotational manner to compress the spring 112. That is, the boss 114 on the body portion 122 of the trigger 14 slides in the first cam slot 126_away from the nosepiece assembly 26 of the tool 10, while the boss 116 on the tail portion 124 of the trigger 14 slides in the second cam slot 128 down the handle assembly 12 of the tool 10 towards the base 16 (FIG. 7B). In this manner, the trigger 14 provides the feel of a sliding trigger with a rotational motion. As such, the trigger 14 of the present invention provides the desirable ergonomic feel of a rotational trigger without the excessive space required by a sliding trigger.

It should be noted that the optimum ergonomic motion of the user's trigger finger is perpendicular to the center of the handle. In the design of the trigger 14 of the present invention, the perpendicular motion is provided by the first cam slot 126. Notwithstanding, it should be understood that the first cam slot 126 is preferably not truly perpendicular to the center of handle 12, but is angled slightly toward the base 16 to assist in the rotational motion of the trigger 14 through the first cam slot 126 the second cam slot 128. In this regard, it is preferable that the vertical cam slot be angled between 45 and 85 degrees and, preferably, between 60 and 80 degrees. Further, another advantageous aspect of the trigger 14 is the forward tab 123 on the trigger 14. This forward tab 123 can be used to interface with the trigger switch and provides a load that is well off center in comparison to a sliding trigger design, making the trigger 14 less prone to racking.

Although the trigger 14 in the above embodiment is described as including two bosses, the present invention should not be limited thereto. That is, referring to FIG. 8, the trigger may include only a single boss 114 with the other boss 116 being converted into a cam slot 130, or the trigger 14 may have a configuration which includes two cam slots instead of the bosses. In FIG. 8, the body portion 122 of the trigger 14 includes the boss 114 and the tail portion 124 of the trigger 14 includes a cam slot 130, with a boss 132 being built into a side of the housing 20. It should be understood, however, that the tail portion 124 of the trigger 14 may include the boss, and the body portion 122 of the trigger 14 may include the cam slot.

Figure 9:
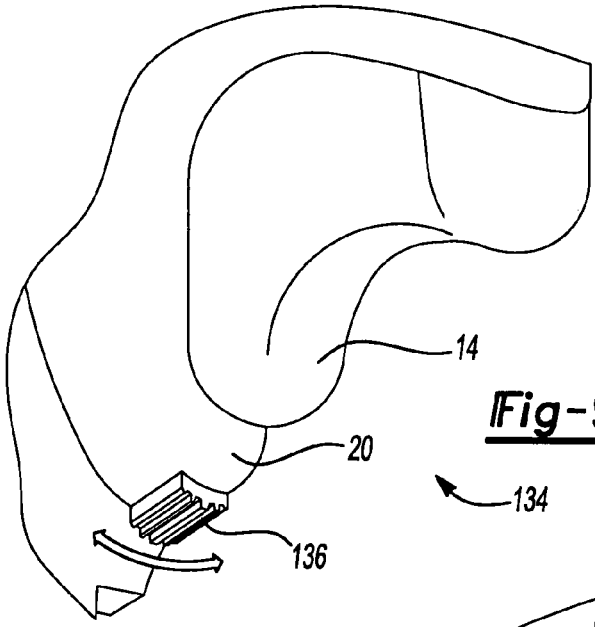
FIG. 9 is a perspective view of a trigger lock according to the principles of the present invention.

The present invention also provides a trigger locking device 134 that prevents the trigger 14 from being depressed when in a locked position. Referring to FIGS. 1 and 9, the trigger locking device 134 is disposed above the trigger 14, towards the nosepiece assembly 26. As best shown in FIG. 9, an adjustment grip 136 of the trigger locking device 134 protrudes out from the housing 20 of the tool 10. The trigger lock device 134 is a rotatable device that rotates between a locked and unlocked position. Preferably, the trigger lock 134 rotates through an angle of approximately 21.5° in the direction of the arrow shown, but the present invention should not be limited thereto.

Figure 10:
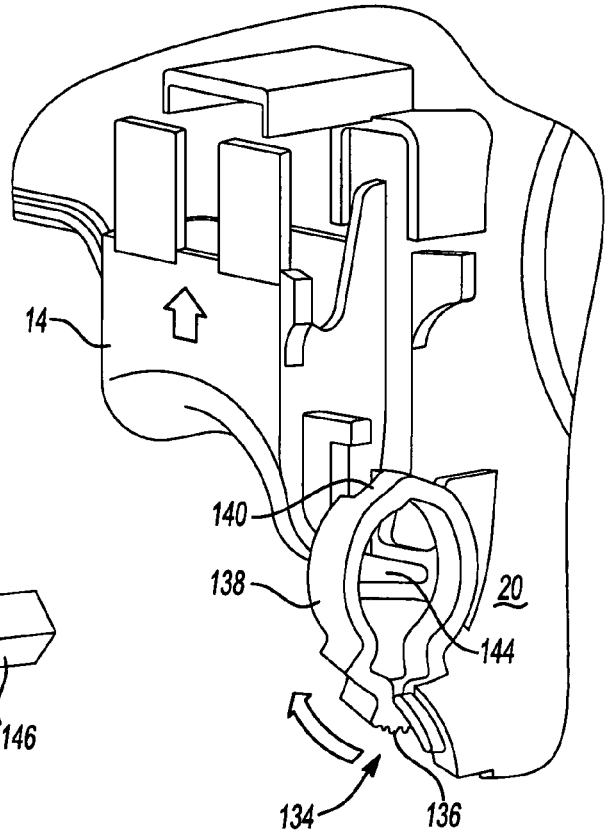
FIG. 10 is a cut-away perspective view of the trigger lock within the housing of the tool.

Now referring to FIG. 10, the complete trigger locking device 134 is shown. The trigger lock 134 is preferably a unitary piece, formed of a plastic or metal, which sits in the housing 20 of the tool 10. In addition to the adjustment grip 136, the trigger locking device 134 includes a ring element 138 that extends from the adjustment grip 136 that allows the trigger locking device 134 to rotate within the housing 20.

The ring element 138 of the trigger locking device 134 includes a slot 140. This slot 140 corresponds to a lock rib 142 that is located on the trigger 14. When the trigger locking device 134 is rotated to an unlocked position, the slot 140 is in a position that allows the lock rib 142 of the trigger 14 to pass through. In this manner, the trigger 14 can be depressed to activate the tool 10 and discharge a fastener.

Figure 11:
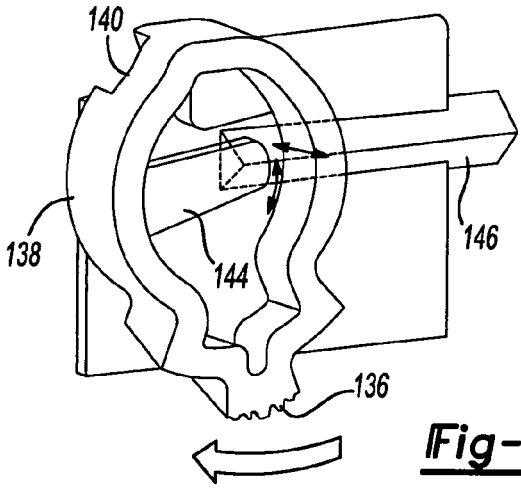
FIG. 11 is a perspective view of the trigger lock mechanism.

As illustrated in FIG. 11, the ring element 138 of the trigger locking device 134 also includes a catch member 144 that engages with a locking flange 146 located on an inside wall of the housing 20. As shown in FIG. 11, the locking flange 146 has a triangular cross-section. When the user moves the trigger locking device 134 from a first position (locked position) to a second position (unlocked position), the catch member 144 is rotated along with the ring element 138 to disengage the locking flange 146.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A trigger assembly for a power tool, comprising a trigger including a main body portion and a tail portion, said main body portion and said tail portion each being slidably engageable within a housing of the tool, wherein upon depression of said trigger, the assembly slides within the housing such that the assembly moves in a rotational motion relative to and within the housing; and wherein said main body portion includes a first boss that is engaged with a first cam slot, and said tail portion includes a second boss that is engaged with a second cam slot.

2. The trigger assembly according to claim 1, wherein said first cam slot is angularly disposed between 45° and 85° from said second cam slot.

3. A tripper assembly for a power tool, comprising:

a tripper including a main body portion and a tail portion, said main body portion and said tail portion each being slidably engageable within a housing of the tool;

wherein upon depression of said trigger, the assembly slides within the housing such that the assembly moves in a rotational motion relative to and within the housing; and wherein at least one of said main body portion and said tail includes a cam slot, and said housing of the tool includes at least one boss engaged with said cam slot.

4. The trigger assembly according to claim 3, wherein said body portion includes a tab formed at a forward portion of said body portion.

5. The trigger assembly according to claim 3, wherein said body portion is a saddle shape.

6. A trigger assembly for a power tool, comprising:

a trigger including a main body portion and a tail portion, said main body portion and said tail portion each being slidably engageable within a housing of the tool, said main body portion including a first boss that is engaged with a first cam slot formed in said housing of the tool, and said tail portion includes a second boss that is engaged with a second cam slot formed in said housing of the tool, wherein upon depression of said trigger, the first boss slides within the first cam slot and the second boss slides within the second cam slot such that the assembly moves in a rotational motion relative to the housing.

7. The trigger assembly according to claim 6, further comprising a spring engaged with said trigger for returning said trigger to an undepressed state after depression.

8. The trigger assembly according to claim 6, wherein said trigger is a monolithic piece.

9. The trigger assembly according to claim 6, wherein said tail portion of said trigger is engaged with said second cam slot including an opening at one end that is defined by a pair of angled ribs.

* * * * *